United States Patent [19]

Spector et al.

[11] Patent Number: 4,509,601

[45] Date of Patent: Apr. 9, 1985

[54] DISCRIMINATION CIRCUITRY FOR FIRE AND EXPLOSION SUPPRESSION APPARATUS

[75] Inventors: Yehiel Spector, Tel Aviv; Ilan Cohen, Petach Tikva, both of Israel

[73] Assignee: Spectronix Ltd., Tel Aviv, Israel

[21] Appl. No.: 481,054

[22] Filed: Mar. 30, 1983

[30] Foreign Application Priority Data

Apr. 18, 1982 [IL] Israel ..... 65517

[51] Int. Cl.[3] ..... A62C 37/18; G08B 17/00

[52] U.S. Cl. ..... 169/61; 340/527; 340/587

[58] Field of Search ..... 169/16, 60, 61; 340/527–529, 587

[56] References Cited

U.S. PATENT DOCUMENTS 3,653,016 3/1972 Cormier ..... 340/228
3,665,440 5/1972 McMenamin ..... 340/228.2
3,831,318 8/1974 Richmond ..... 169/61
4,270,613 6/1981 Spector et al. ..... 169/61

FOREIGN PATENT DOCUMENTS 2395762 1/1979 France ..... 169/61

*Primary Examiner*—Andres Kashnikow
*Assistant Examiner*—James R. Moon, Jr.
*Attorney, Agent, or Firm*—Browdy and Neimark

[57] ABSTRACT

Discrimination apparatus for use in a fire and explosion detection and suppression system which includes plural detectors and suppression apparatus operated thereby and including apparatus for sensing detection by a first number of detectors within a predetermined time period and providing an output signal only when the first plurality of detectors detect within the predetermined time period and apparatus operative in response to the output signal for inhibiting operation of the suppression apparatus.

5 Claims, 2 Drawing Figures

DISCRIMINATION CIRCUITRY FOR FIRE AND EXPLOSION SUPPRESSION APPARATUS

FIELD OF THE INVENTION

The present invention relates to fire and explosion detection apparatus generally and more particularly to discrimination circuitry useful with such apparatus.

BACKGROUND OF THE INVENTION

There are known a number of fire and explosion detection systems. Examples of such systems employing UV and IR detectors are illustrated in the following U.S. Pat. Nos. 3,665,440, 3,653,016 and 4,270,613. U.S. Pat. No. 4,270,613 of the present applicant/assignee describes a particularly useful detection and suppression system which provides an output indication in response to coincident detection of UV and IR wherein the detection bands exclude the visible spectrum. A particular feature of the system described in U.S. Pat. No. 4,270,613 is immediate response to a detection for actuation of suppression apparatus. Discrimination is made between different types of detections in terms of the number of detections within a predetermined period in certain modes of operation. In such modes, simultaneous or near simultaneous detection by a plurality of detectors results in an increased response in terms of actuation of suppression apparatus.

SUMMARY OF THE INVENTION

The present invention seeks to provide discrimination apparatus useful in the type of system described above, but not necessarily limited to combination of UV and IR detectors. The discrimination circuitry of the present invention is operative to distinguish between instances when an impinging projectile such as a HEAT or kinetic energy round causes a hydrocarbon fire and when it does not.

There is thus provided in accordance with the embodiment of the present invention discrimination circuitry operative in combination with a plurality of detectors and including apparatus for sensing detection in a first plurality of detectors within a predetermined time and means for inhibiting normal operation of suppression apparatus associated with the detectors for a predetermined duration response to an output of the sensing apparatus.

Further in accordance with an embodiment of the present invention, the discrimination circuitry does not provide an inhibiting action when less than the first plurality of detectors detects during the predetermined time.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
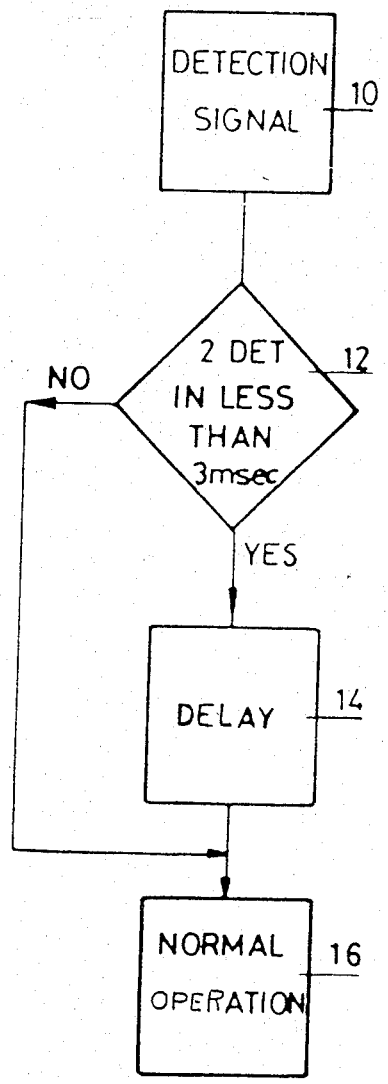
FIG. 1 is a logic diagram illustration of the apparatus of the present invention.

Reference is now made to FIG. 1 which illustrates in a flow chart format the operation of the discrimination circuitry of the present invention. The operating context is a fire and explosion detection and suppression system such as that described in U.S. Pat. No. 4,270,613, the disclosure of which is incorporated herein by reference. The present invention is not limited to such a system.

The system of U.S. Pat. No. 4,270,613 includes a plurality of detectors, logic circuitry and suppression apparatus which is operated by the logic circuitry in response to detection by the detectors. In accordance with the present invention any suitable type of detectors, logic circuitry and suppression apparatus may be used.

In accordance with the present invention a number of detectors are provided for detection of incoming, impinging projectiles, such as HEAT rounds and kinetic energy rounds. When detection occurs at one of the detectors a detection signal 10 is provided. If two detection signals are provided within a predetermined time, typically 3 msecs, an inhibit signal providing a delay in the operation of the suppression apparatus is provided, as indicated at 14. Any desired number of detectors may be employed.

The condition that two detectors are noted within less than 3 msecs means that two separate detection signals are provided by different detectors within the alloted time, indicated at 12.

The inhibition in the operation of the suppression system indicated at 14 typically is of duration 15 msec but may be of any suitable time. This inhibition means that the suppression apparatus is not activated in response to the two detection signals at all and will not respond to any detection signals within the indicated inhibition duration. Normal operation of the suppression apparatus will occur once the inhibition period is terminated, as indicated at 16.

The circuitry whose operation is illustrated in FIG. 1 is designed to discriminate between impinging projectiles such as HEAT rounds and kinetic energy rounds which cause hydrocarbon fires and those which do not. The detection by two detectors within 3 ms. is found to correspond to the passage of a HEAT round or a kinetic energy round through a protected volume. Should no further detection be noted, there is no need for suppression apparatus operation, since no fire has been caused and no explosion will result. A further detection following the inhibit period, will of course, initiate suppression apparatus operation unless the indicated simultaneous detection is again present.

The provision of an extended inhibition period rather than simply disabling response to the indicated simultaneous or near simultaneous detections is provided since following the initial detections, the passage of the projectile through and out of the protected volume may cause addition detections which will also not necessarily result in a fire or explosion and to which it is desired not to respond.

It is noted that the number of detectors required for operation of the inhibit mode may be selected as suitable as may the time period defining simultaneous detection and the duration of the inhibit period. Other types of inhibit circuitry and logic may be combined with the illustrated circuitry as desired.

Figure 2:
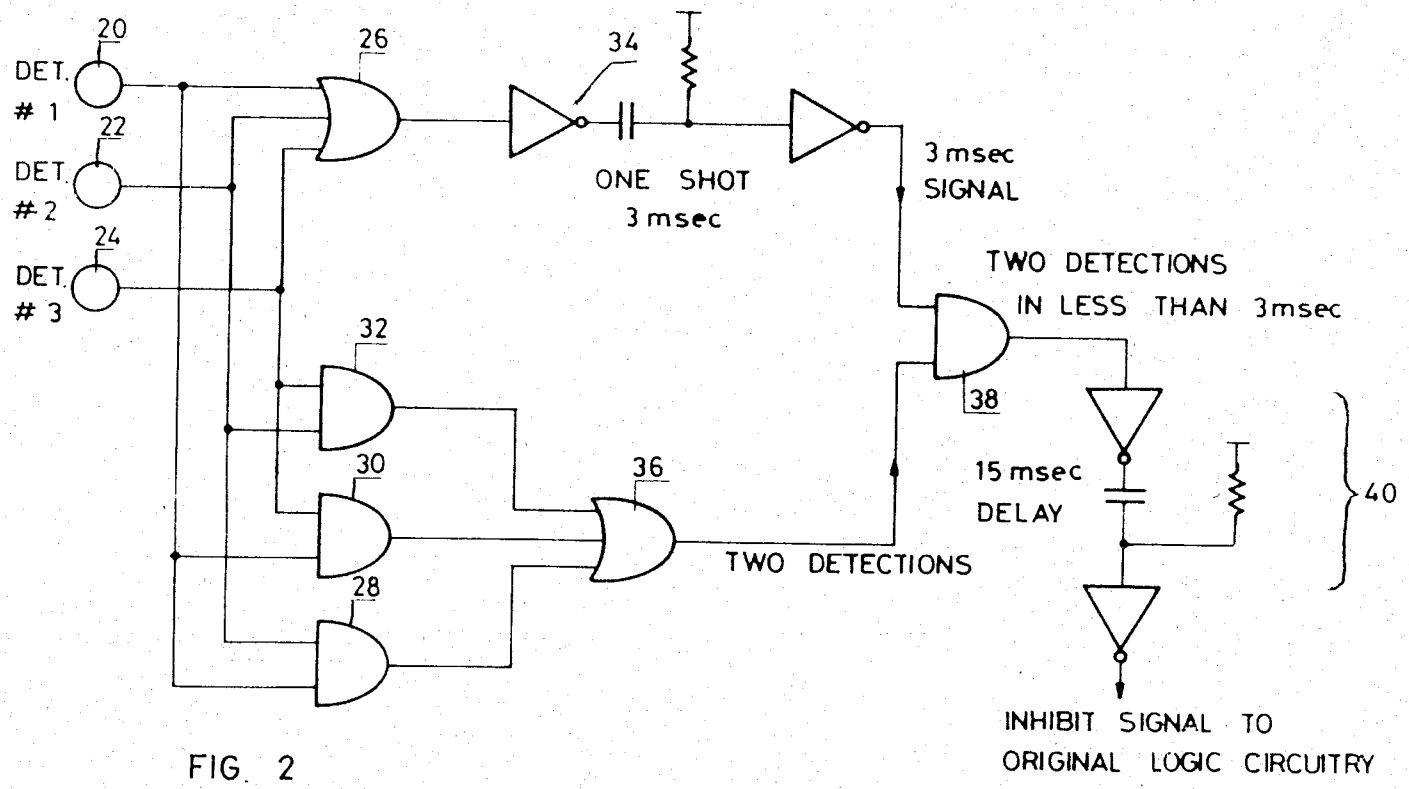
FIG. 2 is an electronic diagram illustration of the apparatus of the present invention.

Reference is now made to FIG. 2 which illustrates an exemplary preferred embodiment of the invention for a typical system including three detectors, 20, 22 and 24. Each of detectors 20, 22 and 24 provides an output to an OR gate 26 indicating the presence of a detection signal and to a pair of AND gates. Detector 20 outputs to AND gates 28 and 30, detector 22 outputs to AND gates 28 and 32 and detector 24 outputs to AND gates 30 and 32.

The output of OR gate 26 is supplied to a one shot circuit 34 whose output is a signal of 3 msec duration. The outputs of AND gates 28, 30 and 32, each of which indicates simultaneous detection by a pair of detectors, are supplied to an OR gate 36 whose output indicates the presence of simultaneous detection by at least one pair of detectors. The outputs of OR gates 26 and 36 are supplied to an AND gate 38 whose output indicates the presence of simultaneous detection by at least two detectors within a 3 ms period beginning with an initial detection.

The output of AND gate 38 is supplied to a delay circuit 40, whose output is an inhibit signal of predetermined duration, typically 15 msec which inhibits normal operation of suppression circuitry.

It will be apparent to persons skilled in the art that the present invention is not limited to what has been particularly shown and described hereinabove. Rather the scope of the present invention is limited only by the claims which follow.

We claim:

1. Discrimination apparatus for use in a fire and/or explosion detection and suppression system including a plurality of detectors and suppression apparatus operated by the detectors, the discrimination apparatus comprising:

means for sensing detection by a first plurality of detectors within a predetermined time period and providing an output signal only when said first plurality of detectors detect within said predetermined time period; and means responsive to an output signal provided by said sensing means indicating detection by said first plurality of detectors within said predetermined time period for inhibiting operation of the suppression apparatus.

2. Discrimination apparatus according to claim 1 and wherein said first plurality of detectors comprises 2 detectors.

3. Discrimination apparatus according to claim 1 and wherein said predetermined time period is approximately 5 ms.

4. Discrimination apparatus according to claim 1 and wherein said sensing means is operative to sense only simultaneous detection by a first plurality of detectors.

5. Discrimination apparatus according to claim 1 and wherein said inhibiting means is operative to provide an inhibiting signal of duration approximately 15 ms.

* * * * *